United States Patent [19]

Teranishi et al.

[11] 4,316,169

[45] Feb. 16, 1982

[54] WINDINGS FOR ELECTRICAL INDUCTIVE APPARATUS

[75] Inventors: Tsuneharu Teranishi; Takeshi Higuchi, both of Yokohama, Japan

[73] Assignee: Tokyo Shibaura Denki Kabushiki Kaisha, Kawasaki, Japan

[21] Appl. No.: 207,998

[22] Filed: Nov. 18, 1980

[30] Foreign Application Priority Data

Nov. 19, 1979 [JP] Japan ..... 54-148837

[51] Int. Cl.[3] ..... H01F 15/14

[52] U.S. Cl. ..... 336/70; 336/187

[58] Field of Search ..... 336/69, 70, 186, 187

[56] References Cited

U.S. PATENT DOCUMENTS 3,260,978 7/1966 Müller ..... 336/69 X 3,299,385 1/1967 Stein ..... 336/70 X

*Primary Examiner*—Thomas J. Kozma

*Attorney, Agent, or Firm*—Oblon, Fisher, Spivak, McClelland & Maier

[57] ABSTRACT

Windings for electrical inductive apparatus are disclosed which include a plurality of first and second pairs of disc coil sections arranged in a stack. Each of the second pairs of disc coil sections are disposed between the first pairs of disc coil sections. Each of the disc coil sections includes two conductors wound in parallel with each other. Each of the two conductors at the inner ends of each section in the first pair of disc coil sections are connected to each of the two conductors at the inner ends of each section in the second pair of disc coil sections, respectively. One conductor at the outer ends of the two sections in the second pair of disc coil sections is connected to one conductor at the outer ends of the two sections in the first pair of disc coil sections. Each of the three conductors at the outer end of two sections in the second pair of disc coil sections is connected to one of three conductors at the outer end of two sections in the next first pair of disc coil sections, respectively.

7 Claims, 4 Drawing Figures

WINDINGS FOR ELECTRICAL INDUCTIVE APPARATUS

BACKGROUND OF THE INVENTION

1. Field of the Invention

This invention relates in general to electrical inductive apparatus, and more particularly to windings for such apparatus.

2. Description of the Prior Art

Electrical inductive apparatus, such as transformers and reactors, commonly utilize a high voltage winding which includes a plurality of electrically connected disc coils arranged in an axially aligned stack about a winding leg of a magnetic core. When an impulse voltage, such as caused by lightning or switching, is applied to the electrical inductive apparatus, a potential distribution along an axis of the winding thereof is determined by the distribution constant $\alpha$. The distribution constant $\alpha$ is equal to the square root of the ratio of the capacitance Cg of the winding to ground to the series capacitance Cs of the winding.

$$\alpha=\sqrt{Cg/Cs}$$

The smaller the distribution constant $\alpha$, the more linear the potential distribution, due to the impulse voltage, will be across the axial direction of the winding, and the smaller the magnitude of the transient potential oscillation within the winding will be. Since the distribution constant $\alpha$ can be reduced by increasing the series capacitance Cs of the winding, various kinds of high voltage windings having increased series capacitance have been utilized. Interleaved windings are well known examles of such windings.

FIG. 1 shows one example of an interleaved winding. In FIG. 1 a conductor 1 through 10 and a conductor 11 through 20 are wound in parallel with each other on an insulating tube 102 via a ductrail 103 to form a pair of disc coils. The conductor 10 is connected to the conductor 11 at a point X so that the conductor 1 through 10 and the conductor 11 through 20 are connected in series with each other. The conductor 20 is also connected to a conductor 21 of a next pair of disc coils. Thus an interleaved winding 101 is made by connecting a plurality of the pairs of disc coils in series with each other, as is apparent to those skilled in the art. In the interleaved winding 101, the conductor 1 through 10 and the conductor 11 through 20 are wound in parallel with each other, thus being interleaved, and form a capacitor therebetween, the series capacitance of which becomes large. However in the interleaved winding 101, it is essential that two conductors be connected at one point X per pair of disc coils as shown in FIG. 1. It is also essential to wind the two conductors in parallel with each other in order to form a pair of disc coils.

In electrical inductive apparatus for large current use, an interleaved winding where a plurality of conductors are wound in parallel with each other in each of the disc coils is used. FIG. 2 shows an example of such an interleaved winding with a plurality of pairs of disc coils having three parallel conductors a1 through a72, b1 through b72, and c1 through c72. In making a pair of disc coils in the interleaved winding 101A shown in FIG. 2, two times three conductors namely six conductors, must be wound in parallel with each other. Also it is essential to connect three conductors at point X respectively per pair of disc coils (a6 to a7, b6 to b7, c6 to c7).

As described above, it is difficult and time consuming to make a conventional winding where many conductors are wound in parallel with each other in each of the disc coils.

SUMMARY OF THE INVENTION

Accordingly, one object of this invention is to provide a novel winding for an electrical inductive apparatus which can be made easily and rapidly.

Another object of this invention is to provide a novel winding for an electrical inductive apparatus having a large series capacitance.

Still another object of this invention is to provide a novel winding for an electrical inductive apparatus having improved characteristics with respect to impulse voltages.

These and other objects of this invention can be achieved by providing windings for electrical inductive apparatus which include a plurality of first pairs of disc coil sections, each including a first section and a second section arranged in a stack, and a plurality of second pairs of disc coil sections, each including a third section and fourth section arranged in the stack. Each of the second pairs of disc coil sections are disposed between the first pairs of disc coil sections. Each of the first, second, third and fourth sections include two conductors wound in parallel with each other. Each of the two conductors at the inner end of the first section are connected to each of the two conductors at the inner end of the third section, respectively. Each of the two conductors at the inner end of the second section are connected to each of the two conductors at the inner end of the fourth section, respectively. One conductor at the outer end of the third section is connected to one conductor at the outer end of the second section. The other conductor at the outer end of the third section is connected to one conductor at the outer end of a first section in a first pair of disc coil sections disposed adjacent to the second pair of disc coil sections. One conductor at the outer end of the fourth section is connected to the other conductor at the outer end of the adjacently disposed first section, and the other conductor at the outer end of the fourth section is connected to one conductor at the outer end of a second section in the adjacently disposed first pair of disc coil sections.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherin.

DESCRIPTION OF THE PREFERRED EMBODIMENTS

Figure 3:
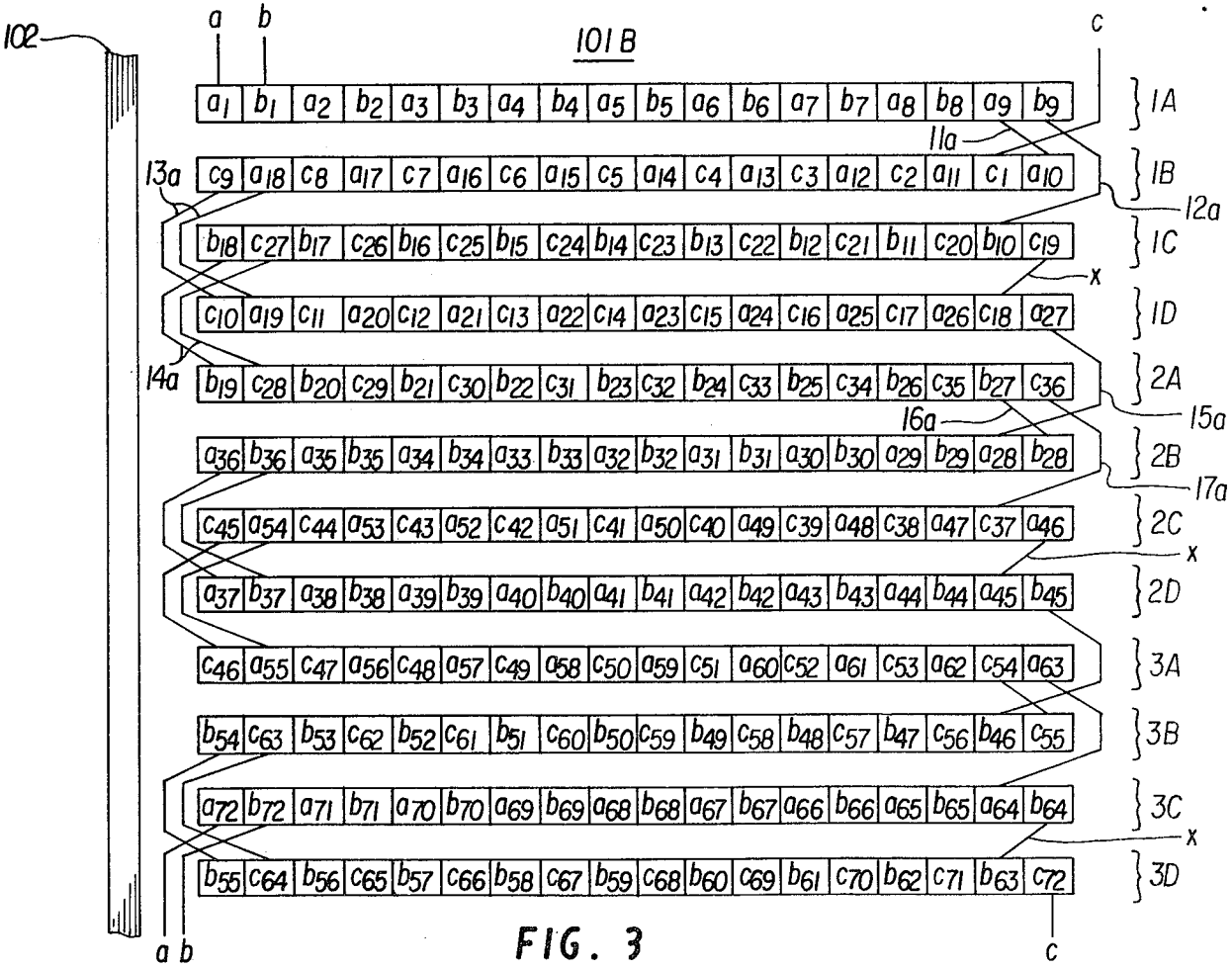
FIG. 3 and FIG. 4 are partial sectional elevation views of a winding according to two preferred embodiments of the present invention.

Referring now to the drawings, wherein like reference numerals designate identical or corresponding parts throughout the several views, and more particularly to FIG. 3 thereof, a winding 101B according to a preferred embodiment of this invention is shown.

In the following discussion, the term "transition" refers to the continuation of a single conductor from one disc coil section to another without the use of splices or other physical coupling means. The conductor retains both its physical and electrical integrity during the "transition". This is to be distinguished from the term "connection" which is a broad concept encompassing both the term "transition" and a narrower concept wherein a junction or splice connection exists between two or more conductors.

In FIG. 3, two conductors, a and b, are wound in parallel with each other from the inside to the outside of the winding 101B in an initial section 1A. An inner conductor (a9) located at the outer end of the section 1A is transitted to an outer conductor (a10) located at the outer end of a section 1B positioned adjacent to the section 1A via an outer transition 11*a*, and the outer conductor (b9) located at the outer end of the section 1A is transitted to an inner conductor (b10) located at the outer end of a section 1C positioned adjacent to the section 1B via an outer transition 12*a*. At the outer end of the section 1B, a new conductor c is added inside the conductor (a10) transitted from the section 1A, and at the outer end of the section 1C a new conductor (c19) is added outside the conductor (b10) transitted from the section 1A. The two sections 1B, 1C are made by winding the two conductors, ac and bc respectively, in parallel with each other from outside to inside. At each of the inner ends of the sections 1B, 1C, two conductors thereof are transitted to two conductors at each of the inner ends of the following sections 1D,2A via inner transitions 13*a*, 14*a* without being transposed, respectively. The two sections 1D, 2A are made by winding the two conductors, ac and bc respectively, in parallel with each other from inside to outside. An inner conductor (c18) at the outer end of the section 1D is connected to the outer conductor (c19) at the outer end of the section 1C, which is added at the beginning of the winding of the section 1C, at a point X. The outer conductor (a27) at the outer end of the section 1D is transitted to an inner conductor (a28) at the outer end of a section 2B located adjacent to the section 2A via an outer transition 15*a*. An inner conductor (b27) at the outer end of the section 2A is transitted to the outer conductor (b28) at the outer end of the section 2B via an outer transition 16*a*, and the outer conductor (c36) at the outer end of the section 2A is transitted to an inner conductor (c37) at the outer end of a section 2C located adjacent to the section 2B via an outer transition 17*a*. The transitions 16*a* and 17*a* from the section 2A to the sections 2B and 2C respectively, are similar to the transitions from the section 1A to the sections 1B, 1C via outer transitions 11*a*, 12*a*. At the outer end of the section 2C a new conductor (a46) is added outside the conductor (c37) transitted from the section 2A. The two sections 2B, 2C are made by winding the two conductors, ab and ac respectively, in parallel with each other from outside to inside. The remainder of the winding 101B is made by continuing to wind the conductors as described above.

Being constructed as described above, the winding 101B with three conductors wound in parallel with each other as a whole is obtained. The order of the turns of the three conductors in the winding 101B are a1 through a72, b1 through b72 and c1 through c72 as shown in FIG. 3. In making a disc coil in the winding shown in FIG. 3, only two conductors are wound parallel with ech other. To make the winding 101B only three connections at the points X are needed for twelve disc coils.

Figure 1:
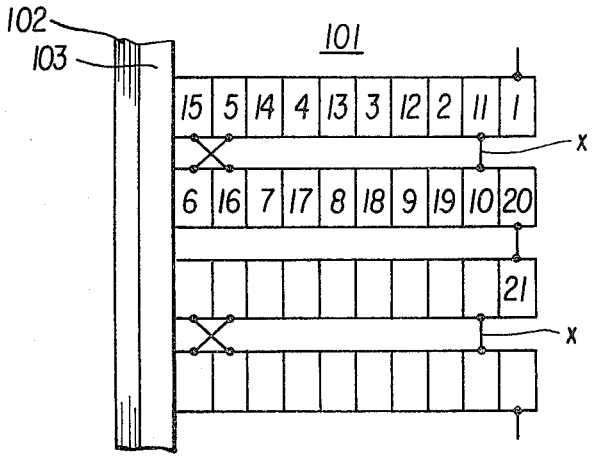
FIG. 1 (PRIOR ART)
FIG. 1 is a partial sectional elevation view of a conventional interleaved winding.
Figure 2:
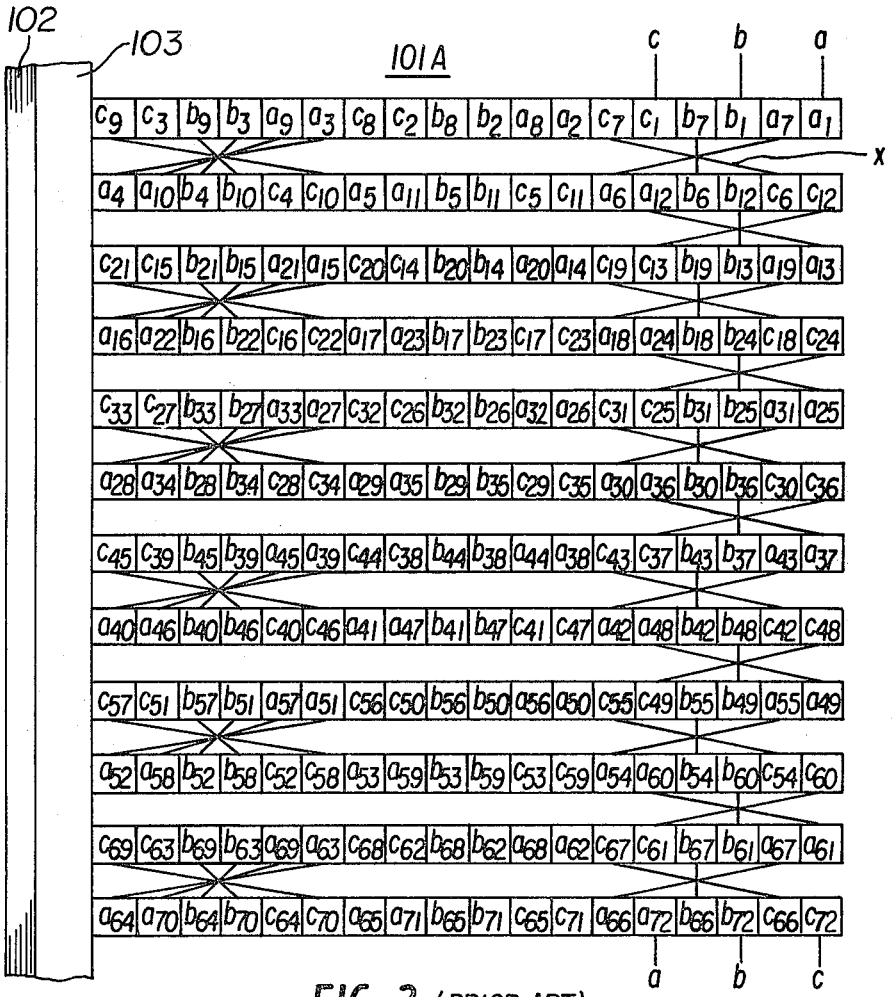
FIG. 2 (PRIOR ART)
FIG. 2 is a partial sectional elevation view of a conventional interleaved winding having three parallel conductors.

The winding 101B shown in FIG. 3 has the same number of turns and the same number of parallel conductors as a whole as those in the interleaved winding 101A shown in FIG. 2. Therefore, comparing the winding 101B with the interleaved winding 101A, the number of points connecting conductors in the winding 101B is only one-sixth of the necessary connecting points in the interleaved winding 101A, and the number of conductors wound in parallel with each other is reduced by one-third. Accordingly, the winding 101B can be made easily and rapidly.

Next, a series capacitance of the winding 101B, according to a preferred embodiment of this invention, will be determined by calculating the static electric energy stored among the conductors in the winding. The static electric energy E per section of a winding is generally determined by equation (1):

$$E=(\tfrac{1}{2})CV^2=(\tfrac{1}{2})\Sigma(Ct)(Vt^2) \qquad (1)$$

WHERE:

C: equivalent capacitance per section
V: voltage per section (V=ne)
Ct: capacitance between conductors per turn
Vt: voltage between conductors
n: the number of turns per section
e: voltage per turn In winding 101B, each of the three conductors a, b and c is wound in eight sections out of the twelve sections 1A through 3D, respectively. Therefore the average number of turns per section n is:

$$n=(8/12)m=(\tfrac{2}{3})m$$

where m is the actual number of turns of the conductor a, b or c per section respectively. In the case of the winding 101B, m=9 and n=6.

Next the voltage Vt between the conductors in each section will be determined. In sections 1B, 1C, 2C and 3B, the number of the position where Vt=me is m, and the number of the position where Vt=(m+1)e is (m−1). In sections 1D, 2A, 3A and 3D, the number of the position where Vt=me is m, and the number of the position where Vt=(m−1)e is (m−1). In sections 1A, 2B, 2D, and 3C, the number of the position where Vt=e is (m−1). Therefore the total static electric energy Et for the twelve sections 1A through 3D is:

$$Et=4[(\tfrac{1}{2})Ct(me)^2m+(\tfrac{1}{2})Ct\{(m+1)e\}^2(m-1)]+4[(\tfrac{1}{2})Ct(me)^2m+(\tfrac{1}{2})Ct\{(m-1)e\}^2(m-1)]+4[(\tfrac{1}{2})Cte^2(m-1)]\approx 4Ct(me)^2(m-1) \qquad (2)$$

Therefore, the static electric energy E per section is determined as:

$$E=(1/12)Et=(\tfrac{1}{3})Ct(me)^2(2m-1)=(\tfrac{1}{2})Ct(ne)^2[(3/2)(3n-1)] \qquad (3)$$

Therefore, the equivalent capacitance C per section is determined by equation (1) and equation (3) as:

$$C=(3/2)(3n-1)Ct \qquad (4)$$

On the other hand, a series capacitance of the interleaved winding 101A with three parallel conductors shown in FIG. 2 will now be determined. In each section the number of the position where Vt=ne is (5/2)n, and the number of the position where Vt=(n−1)e is [(n/2)−1]. In the case of the widning 101A, n is also 6. Therefore, the static electric energy E per section is determined as:

$$E=(\tfrac{1}{2})Ct(ne)^2(5/2)n+(\tfrac{1}{2})Ct[(n-1)e]^2[(n/2)-1]-\approx(\tfrac{1}{2})Ct(ne)^2(3n-2) \quad (5)$$

Therefore, the equivalent capacitance C per section is determined by equation (1) and equation (5) as:

$$C=(3n-2)Ct \quad (6)$$

By comparing equation (4) with equation (6), the series capacitance of the winding 101B, according to the preferred embodiment of this invention, is one and one half times that of the conventional interleaved winding 101A having the same number of turns and the same number of parallel conductors as winding 101B.

Figure 4:
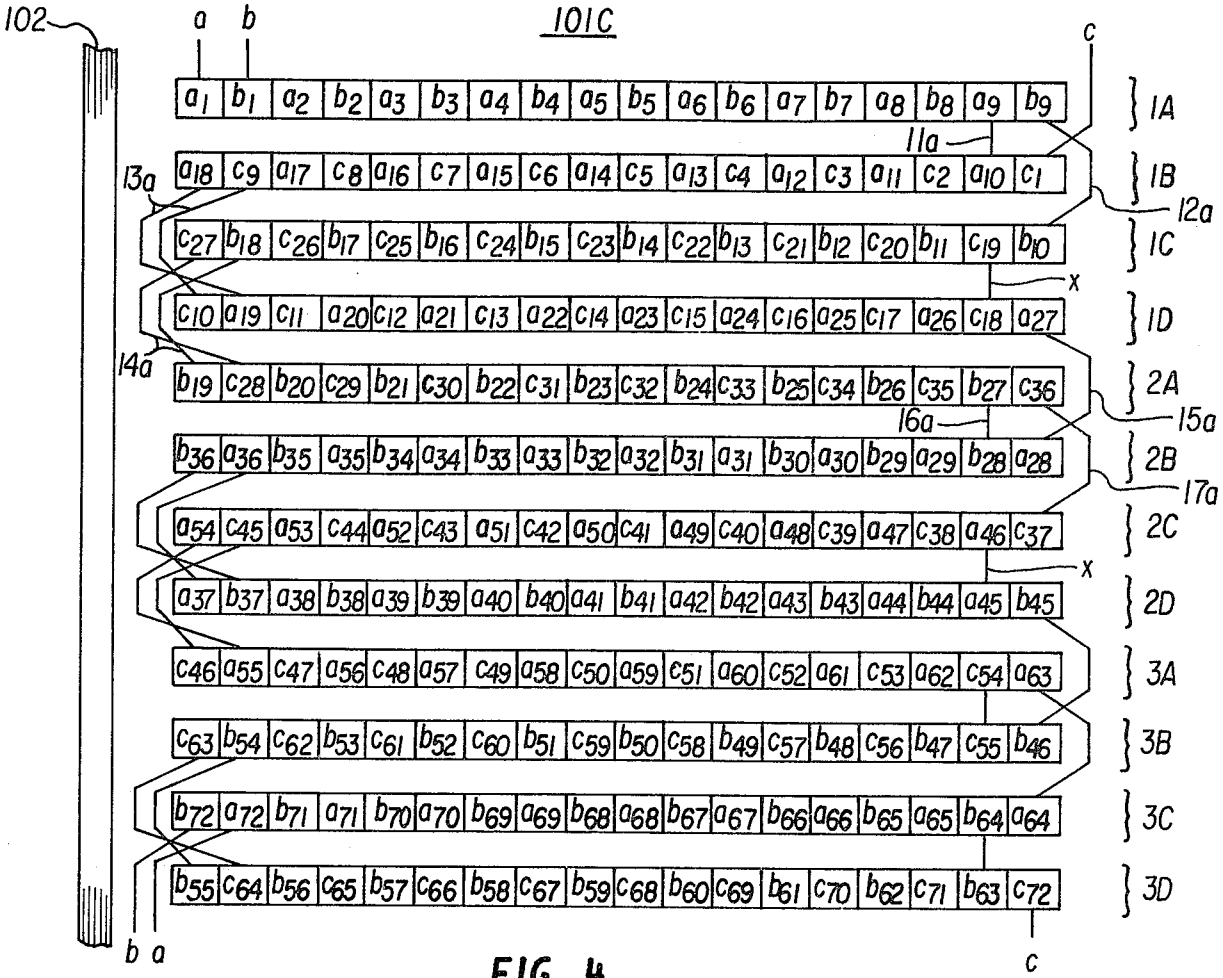

In the winding 101B shown in FIG. 3, transpositions are made in the transitions between the outer ends of two sections but not between the inner ends; however this invention is not restricted to this embodiment. In FIG. 4, a winding 101C according to another preferred embodiment of this invention is shown. This winding 101C has the same construction as that of the winding 101B shown in FIG. 3 except that transpositions are made in the transitions between the inner ends of two sections and not between the outer ends. The winding 101C also has the same effect as the winding 101B shown in FIG. 3; that is, the winding 101C can be made easily and rapidly. The winding 101C also has a large series capacitance and has improved characteristics with respect to impulse voltages.

In the embodiments of the subject invention shown in FIGS. 3 and 4, the sections 1A through 3D have been illustrated as having a particular order. However, since other arrangements are possible in light of the above teachings, the present invention should not be considered as being limited to the order illustrated. For example, the ordering of the individual sections can be reversed in pairs. Thus 1B and 1C can be reversed and 1D and 2A can be reversed. Similary, other pairs of sections can be reversed.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A winding for electrical inductive apparatus, comprising:

a plurality of first pairs of disc coil sections, each of said plurality of first pairs of sections including a first section and a second section arranged in a stack;

a plurality of second pairs of disc coil sections, each of said plurality of second pairs of sections including a third section and a fourth section arranged in said stack;

wherein each of said second pairs of disc coil sections are disposed between said first pairs of disc coil sections;

wherein each of said first, second, third and fourth sections include two conductors wound in parallel with each other;

wherein each of two conductors at an inner end of said first section are connected to each of two conductors at an inner end of said third section, respectively;

wherein each of two conductors at an inner end of said second section are connected to each of two conductors at an inner end of said fourth section, respectively;

wherein a first conductor at an outer end of said third section is connected to a first conductor at an outer end of said second section;

wherein a second conductor at the outer end of said third section is connected to a first conductor at an outer end of a first section in a first pair of disc coil sections disposed adjacent to said second pair of disc coil sections;

wherein a first conductor at an outer end of said fourth section is connected to a second conductor at the outer end of said adjacently disposed first section; and wherein a second conductor at the outer end of said fourth section is connected to a first conductor at an outer end of a second section in said adjacently disposed first pair of disc coil sections.

2. The winding as recited in claim 1, wherein: said first and second pairs of disc coil sections are disposed adjacent to each other such that said first section is disposed adjacent to said second section, said third section is disposed adjacent to said second section, and said forth section is disposed adjacent to said third section.

3. The winding as recited in claim 2, wherein: each of said two conductors at the inner end of said first section are connected to each of said two conductors at the inner end of said third section by being transitted via an inner transition, respectively;

each of said two conductors at the inner end of said second section are connected to each of said two conductors at the inner end of said fourth section by being transitted via an inner transition, respectively;

said second conductor at the outer end of said third section is connected to said first conductor at the outer end of the first section in the first pair of disc coil sections disposed adjacent to said second pair of disc coil sections by being transitted via an outer transition;

said first conductor at the outer end of said fourth section is connected to said second conductor at the outer end of said adjacently disposed first section by being transitted via an outer transition; and said second conductor at the outer end of said fourth section is connected to said first conductor at the outer end of said second section in said adjacently disposed first pair of disc coil sections by being transitted via an outer transition.

4. The winding as recited in claim 3, wherein:

each of said two conductors at the inner end of said first section are connected to each of said two conductors at the inner end of said third section without being transposed, respectively; and each of said two conductors at the inner end of said second section are connected to each of said two conductors at the inner end of said fourth section without being transposed, respectively.

5. The winding as recited in claim 3, wherein:

each of said two conductors at the inner end of said first section are connected to each of said two conductors at the inner end of said third section by being transposed, respectively; and each of said two conductors at the inner end of said second section are connected to each of said two conductors at the inner end of said fourth section by being transposed, respectively.

6. The winding as recited in claim 4, wherein:

an inner conductor at the outer end of said third section is connected to an outer conductor at the outer end of said second section;

an outer conductor at the outer end of said third section is connected to an inner conductor at the outer end of the first section in the first pair of disc coil sections disposed adjacent to said second pair of disc coil sections;

an inner conductor at the outer end of said fourth section is connected to an outer conductor at the outer end of said adjacently disposed fist section; and an outer conductor at the outer end of said fourth section is connected to an inner conductor at the outer end of the second section in said adjacently disposed first pair of disc coil sections.

7. The winding as recited in claim 5, wherein:

an inner conductor at the outer end of said third section is connected an inner conductor at the outer end of said second section;

an outer conductor at the outer end of said third section is connected to an outer conductor at the outer end of the first section in the first pair of disc coil sections disposed adjacent to said second pair of disc coil sections;

an inner conductor at the outer end of said fourth section is connected to an inner conductor at the outer end of said adjacently disposed first section; and an outer conductor at the outer end of said fourth section is connected to an outer conductor at the outer end of the second section in said adjacently disposed first pair of disc coil sections.

* * * * *